US011946248B2

(12) United States Patent
Forsland

(10) Patent No.: US 11,946,248 B2
(45) Date of Patent: Apr. 2, 2024

(54) RETRACTABLE ROOF STRUCTURE

(71) Applicant: Cabrio Structures LLC, River Falls, WI (US)

(72) Inventor: Kent Harry Forsland, River Falls, WI (US)

(73) Assignee: CABRIO STRUCTURES LLC, River Falls, WI (US)

( * ) Notice: Subject to any disclaimer, the term of this patent is extended or adjusted under 35 U.S.C. 154(b) by 0 days.

(21) Appl. No.: 17/854,576

(22) Filed: Jun. 30, 2022

(65) Prior Publication Data

US 2023/0059555 A1 Feb. 23, 2023

Related U.S. Application Data

(60) Provisional application No. 63/216,740, filed on Jun. 30, 2021.

(51) Int. Cl.
*E04B 7/16* (2006.01)

(52) U.S. Cl.
CPC ..... *E04B 7/166* (2013.01)

(58) Field of Classification Search
CPC .... E04B 1/34305; E04B 1/34368; E04B 7/16; E04B 7/166
See application file for complete search history.

(56) References Cited

U.S. PATENT DOCUMENTS

| | | | | |
|---|---|---|---|---|
| 4,271,644 | A * | 6/1981 | Rilliet | E04B 1/0046 52/67 |
| 4,616,451 | A * | 10/1986 | Glick | E04B 7/166 52/72 |
| 7,752,815 | B2 * | 7/2010 | Lauria | E04B 7/166 52/6 |
| 8,381,452 | B1 * | 2/2013 | Forsland | E04B 7/166 52/64 |
| 8,701,356 | B2 | 4/2014 | Forsland et al. | |
| 8,707,632 | B2 | 4/2014 | Forsland et al. | |
| 9,915,062 | B2 | 3/2018 | Forsland et al. | |
| 10,151,109 | B2 | 12/2018 | Forsland | |
| 10,934,708 | B2 | 3/2021 | Forsland | |
| 11,060,285 | B2 | 7/2021 | Forsland | |
| 2012/0000141 | A1 * | 1/2012 | Forsland | E04B 1/343 52/66 |
| 2020/0024847 | A1 * | 1/2020 | Forsland | E04B 1/34357 |

* cited by examiner

*Primary Examiner* — Christine T Cajilig
(74) *Attorney, Agent, or Firm* — Merchant & Gould P.C.

(57) ABSTRACT

The present disclosure relates to building structures having roof arrangements that can be extended and retracted. Roof arrangements having ridge beams are disclosed. Building structures having double roof arrangements are also disclosed.

19 Claims, 11 Drawing Sheets

RETRACTABLE ROOF STRUCTURE

CROSS-REFERENCE TO RELATED APPLICATION

This application claims priority to U.S. Provisional Patent Application Ser. No. 63/216,740, filed on Jun. 30, 2021, the entirety of which is incorporated herein by reference in its entirety.

BACKGROUND

The present disclosure relates in general to the field of enclosures, and more particularly, to enclosures that include a selectively retractable roof.

Some enclosures for use outdoors are typically constructed to cover a predetermined area to protect the predetermined area from exposure to the elements. These enclosures suffer from a number of disadvantages. For instance, such enclosures are typically constructed so as to permanently cover the predetermined area. This may be undesirable where coverage for the predetermined area is only necessary or desired for a given period of time and where exposure to the elements may be desired on occasion. Further, such enclosures are generally not selectively configurable and are permanent in nature.

Some other such enclosures are configured for temporary use whereby they may be constructed to cover the predetermined area and taken down after use thereof. However, such enclosures are typically generally not capable of withstanding a wide variety of weather conditions such as wind, rain, and snow.

Patents disclosing example retractable roof structures include U.S. Pat. Nos. 10,934,708; 8,701,356; 9,915,062; 8,381,452; 8,707,632 and 10,151,109.

SUMMARY

Aspects of the present disclosure relate to roof arrangements that are movable between extended state and retracted state. In certain examples, the extended states correspond to the roofs being closed and the retracted states correspond to the roofs being open. The roof arrangements can include peaked roof sections configured to telescopically nest with respect to one another. The roof arrangements can include a ridge beam that extends beneath the peaks of the roof sections. A roller arrangement can be provided for transferring load from the roof sections to the ridge beam such that the rigid beam can provide support at mid regions of the spans of the roof sections while concurrently allowing the roof sections to be movable relative to one another between the extended position and the retracted position. In preferred examples, the roller arrangement is configured to transfer load from overlying roof sections through underlying roof sections to the ridge beam.

Another aspect of the present disclosure relates to a roof arrangement including first and second headers that are parallel with respect to one another. The roof arrangement also includes a first set of tracks supported above the first header and a second set of tracks supported above the second header. The first and second sets of tracks run lengthwise along lengths of the first and second headers. The roof arrangement further includes a ridge being elevated with respect to the first and second headers. The ridge beam is parallel to the first and second headers and is positioned at an intermediate location between the first and second headers. The roof arrangement further includes a first roof section that is movable along the first and second sets of tracks. The first roof section includes a first end supported at a first track of the first set of tracks and a second end supported at a first track of the second set of tracks. The first roof section also includes a peak positioned above the ridge beam. The roof arrangement also includes first and second rollers carried with the first roof section and spaced-apart along the peak of the first roof section for transferring load from the first roof section downwardly to the ridge beam. The roof arrangement also includes a second roof section that is movable along the first and second sets of tracks. The second roof section includes a first and supported at a second track of the first set of tracks and a second end supported at a second track of the second set of tracks. The second roof section includes a peak positioned above the rigid beam. The second tracks of the first and second sets of tracks are positioned outside the first tracks of the first and second sets of tracks. The roof arrangement further includes third and fourth rollers carried with the second roof section and spaced-apart along the peak of the second roof section for transferring load from the second roof section downwardly to the ridge beam. The third roller rides above the peak of the first rough section such that the load from the second roof section is transferred from the third roller through the first roof section to the ridge beam. The fourth roller rides above the ridge beam and is arranged such that load from the second roof section is transferred to the ridge beam without passing through the first roof section. The first roof section is nestable within the second roof section. When the roof arrangement is in a retracted state at least a majority of the first roof section is nested within the second roof section. When the roof arrangement is in the extended state at least a majority of the first roof section extends beyond the second roof section.

Another aspect of the present disclosure relates to a building structure defining a room having a convertible area. The building structure includes a first roof arrangement movable between an extended state and a retracted state. When the first roof arrangement is in the extended state, the first roof section extends over the convertible area. When the first roof arrangement is in the retracted state, the first roof section does not extend over the convertible area. The building structure also includes a second roof arrangement movable between an extended state and a retracted state. When the second roof arrangement is in the extended state, the second roof section extends over the convertible area. When the second roof arrangement is in the retracted state, the second roof section does not extend over the convertible area. One of the first and second roof arrangements is positioned higher than the other of the first and second roof arrangements so as to be capable of extending over the other of the first and second roof arrangements at least when the first and second roof sections are in the extended state. The first and second roof arrangements are separate roof arrangements that are independently moveable between the extended and retracted states. The first roof arrangement and the second roof arrangement have different thermal resistance values or have different light transmission properties.

In one example, the second roof arrangement is positioned above the first roof arrangement.

In one example, the convertible space has a distance that can be opened and closed by the first and second roof arrangements, wherein the distance extends along an orientation of movement of the first and second roof arrangements as the first and second roof arrangements move between the retracted and extended states, and wherein the first and second roof arrangements extend fully along the distance when in the extended states.

In one example, the first roof arrangement is light-transmissive and the second roof arrangement is room darkening.

In one example, the second roof arrangement has an R-value at least 2, 3, 4, 5, 10 or 15 times as large as an R-value of the first roof arrangement.

In one example, the building structure is configured to provide the room with an open air configuration when the first and second roof arrangements are in the retracted state, a covered light transmissive configuration when the first roof arrangement is in the extended state and the second roof arrangement is in the retracted state, and a room darkening configuration when the first and second roof arrangements are in the extended state.

In one example, the building structure provides the look and feel of a traditional roof (e.g., shingled design, corrugated metal design, standing seam design, etc.) when the second roof arrangement is closed.

A variety of additional aspects will be set forth in the description that follows. The aspects relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

The present application incorporates by reference U.S. Pat. Nos. 10,934,708; 8,701,356; 9,915,062; 8,381,452; 8,707,632 and 10,151,109 in their entireties. The incorporated patents disclose various examples of convertible enclosures, including enclosures having retractable roof systems with various roller and track arrangements suitable for accommodating relative movement of roof sections of the roof systems.

Figure 1:
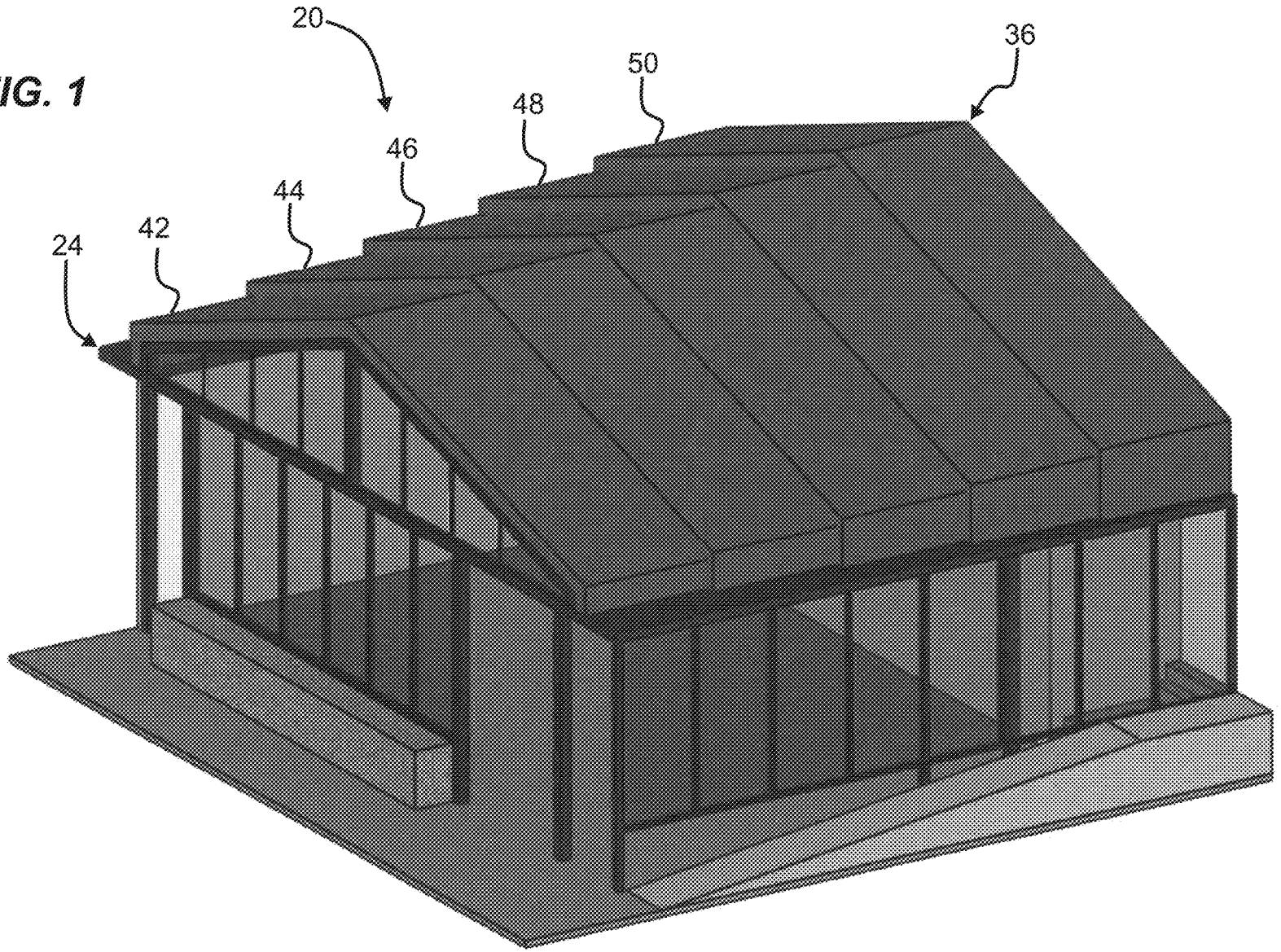
FIG. 1 depicts a building in accordance with the principles of the present disclosure having a roof arrangement movable between a retracted state and an extended state, the roof arrangement is shown in the extended state at FIG. 1.
Figure 2:
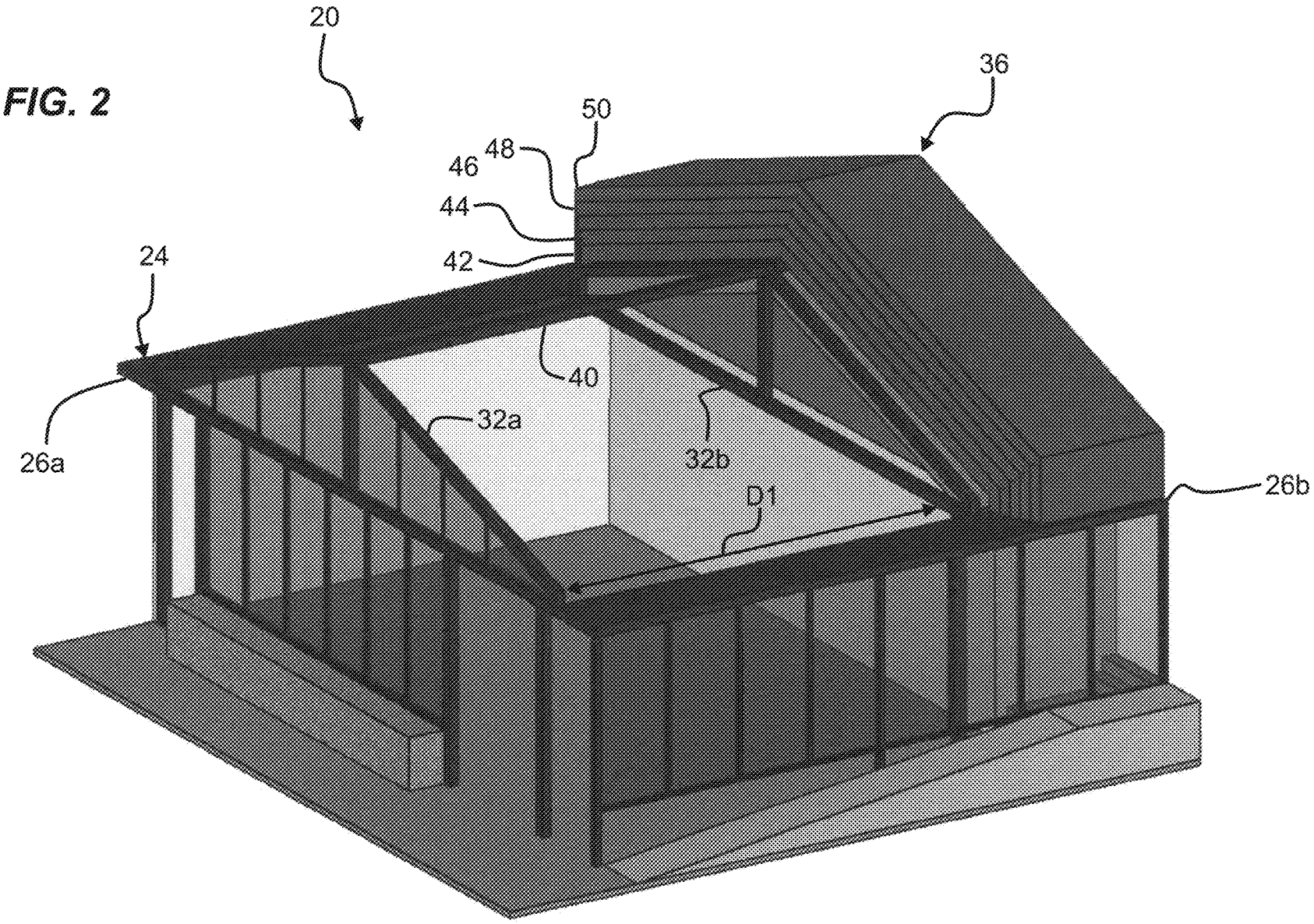
FIG. 2 depicts the building of FIG. 1 with the roof arrangement in the retracted state.
Figure 3:
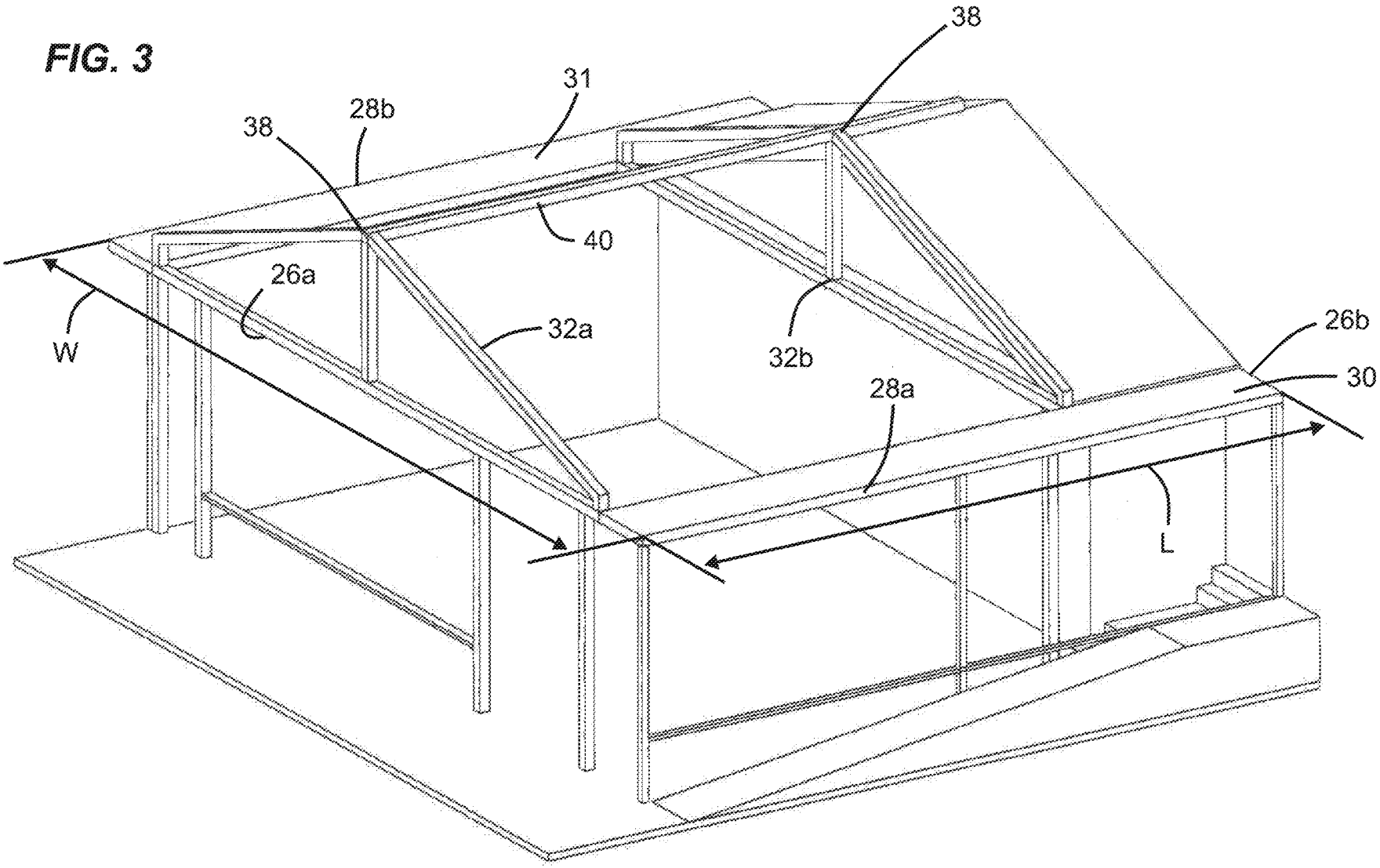
FIG. 3 depicts a support frame for supporting roof sections of the roof arrangement of FIG. 1.

FIGS. 1 and 2 depict a building 20 in accordance with the principles of the present disclosure. The building includes a frame 24 having opposite first and second end walls 26*a*, 26*b* defining a width W of the building 20 and opposite first and second side walls 28*a*, 28*b* defining a length L of the building 20. The end walls 26*a*, 26*b* and the side walls 28*a*, 28*b* can be supported on a foundation or other structure. The first and second side walls 28*a*, 28*b* preferably include respective first and second headers 30, 31 positioned at the tops of the sidewalls 28*a*, 28*b* preferably above head level (e.g., preferably above at least 6 feet, 7 feet or 8 feet). The headers 30, 31 are depicted extending along the length L of the building 20. The frame 24 can also include trusses 32 that extend across the width W of the building 20. For example, a first truss 32*a* is positioned above and supported on the first and wall 26 a and a second truss 32*b* is spaced from the first truss by a distance D1 measured along the length L of the building 20. In one example, the distance D1 corresponds to a region of a roof arrangement 36 of the building 20 that can be opened. The second truss 32*b* spans the width W of the building 20 and is supported at opposite ends by the first and second headers 30*a*, 30*b*. The trusses 32*a*, 32*b* have peaks 38. In the depicted example, the peaks 38 are positioned at a mid-region (e.g., a midline) of the width W of the building 20. A ridge beam 40 extends along the length L of the building and is supported at the peaks 38 of the trusses 32.

The roof arrangement 36 of the building 20 is preferably movable between a retracted state (shown at FIG. 2) and an extended state (shown at FIG. 1). It will be appreciated that the openable region of the roof arrangement 36 corresponding to the distance D1 is open when the roof arrangement is in the retracted state and is closed when the roof arrangement 36 is in the extended state.

The roof arrangement 36 includes a first roof section 42 that nests within a second roof section 44, a third roof section 46 in which the second roof section 44 nests, a fourth roof section 48 in which the third roof section 46 nests, and fifth roof section 51 in which the fourth roof section 48 nests. In the depicted example, the fifth roof section 51 is a fixed roof section that is not movable along the lengths of the headers 30 and the first, second, third and fourth roof sections 42, 44, 46 and 48 are movable relative to one another along the lengths of the headers 30. Preferably, the roof sections are configured to telescopic the nest with respect to one another. When the roof arrangement is in the retracted state, a majority of each of the roof sections 42, 44, 46 and 48 is nested within its corresponding overlying roof section. When the roof arrangement is in the extended state, a majority of each of the roof sections 42, 44, 46 and 48 is extends outwardly beyond its corresponding overlying roof section.

The roof sections 42, 44, 46 and 48 include opposite first and second lower ends 50, 52 positioned at the first and second headers 30, 31. Thus, the roof sections 42, 44, 46 and 48 are configured to span the width W of the building. The ridge beam 40 provides support to the roof sections 42, 44, 46 and 48 at a mid-region along the width W. In a preferred example, the ridge beam 40 provides support at peaks 38 of the roof sections 42, 44, 46, 48. The roof sections 42, 44, 46 and 48 can include portions that angle downwardly from their peaks to the first and second lower ends 50, 52 of each of the roof sections 42, 44, 46 and 48. In certain examples, the roof sections can include roof section frames that support roof panels of the roof sections. In certain examples, the roof panels can be transparent or opaque.

Figure 4:
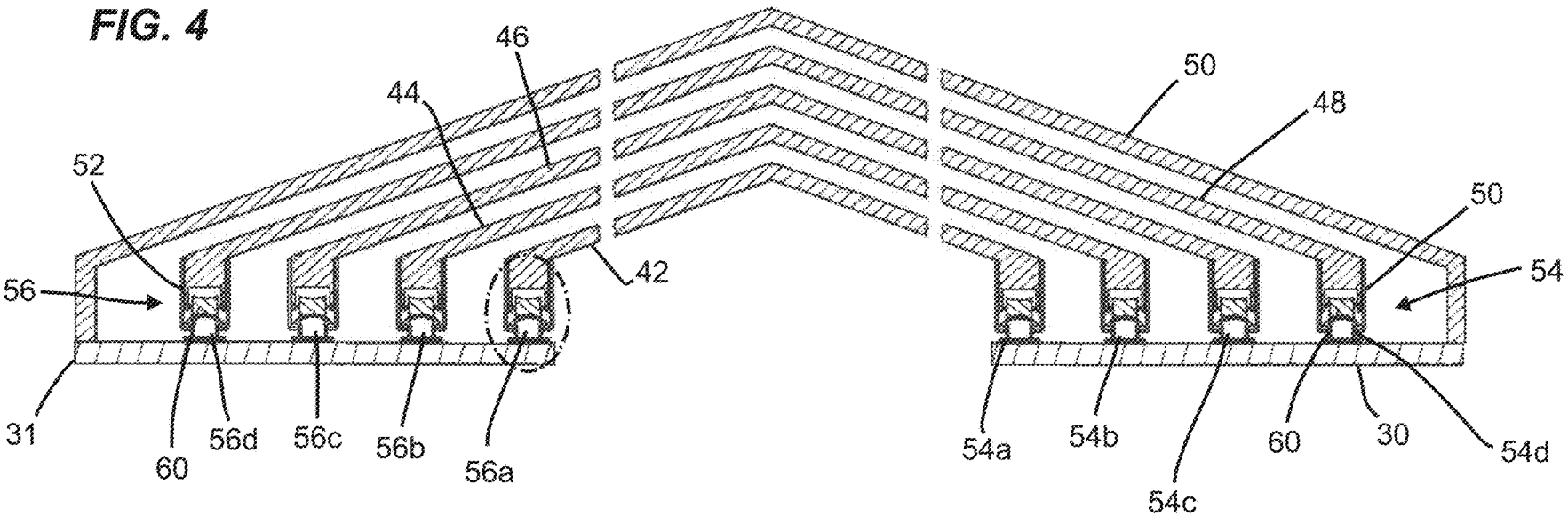
FIG. 4 schematically depicts end roller arrangements for the roof sections of the roof arrangement of the building of FIG. 1.
Figure 5:
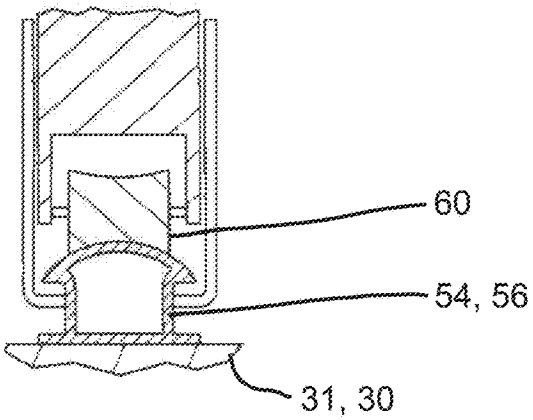
FIG. 5 is an enlargement of one of the end rollers of FIG. 4.
Figure 6:
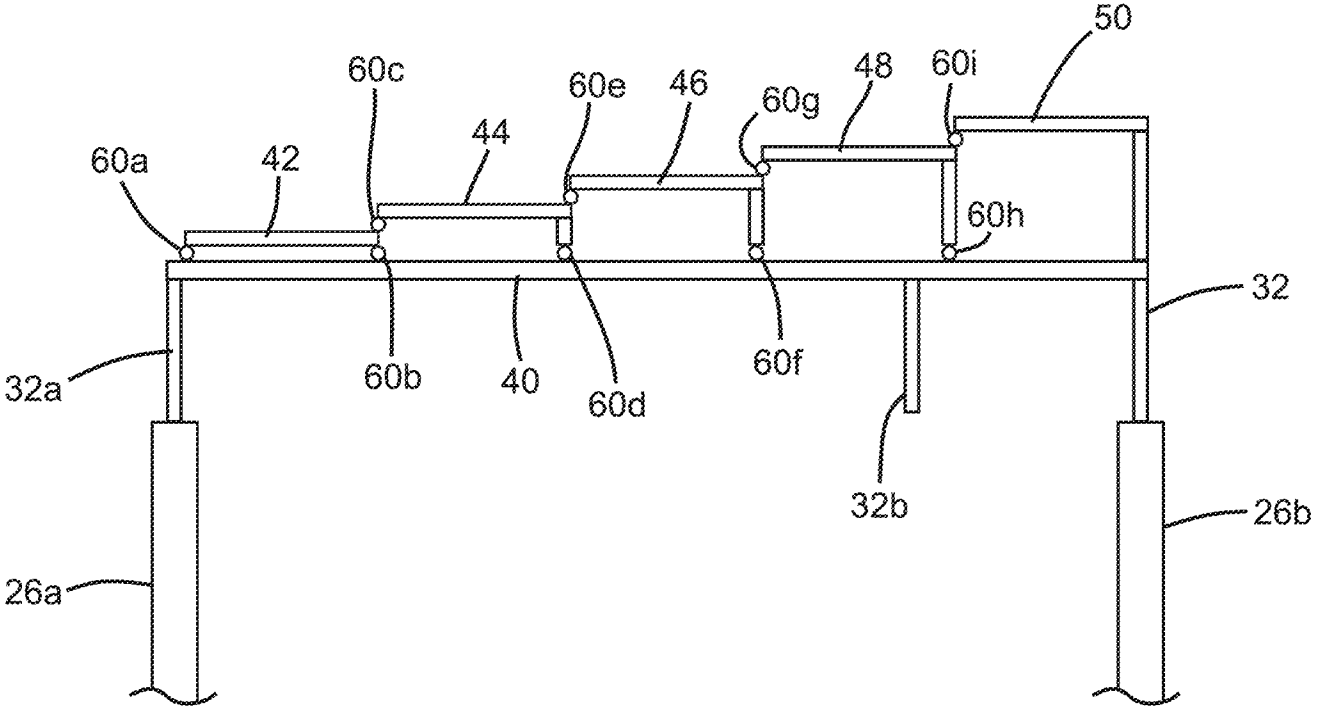
FIG. 6 is a schematic view showing a peak roller arrangement for transferring a load from the roof sections to a ridge beam of the roof arrangement of the building of FIG. 1.

Referring to FIG. 4, the lower ends 50, 52 are respectively moveably supported on first and second sets of tracks 54, 56 which are respectively supported on the first and second headers 30, 31. The sets of tracks 54, 56 extend along the length of the building 20 and along the lengths of the headers 30, 31. Rollers 60 can be carried with the roof sections 42, 44, 46 and 48 and can be configured to ride along the sets of tracks 54, 56 as the roof sections 42, 44, 46 and 48 are moved between the retracted and extended states. The rollers and tracks are configured to be suitable for allowing relative movement between the roof sections. The first set of tracks 54 can include first, second, third and fourth tracks 54*a*-54*d* that respectively support the first ends 50 of the first, second, third and fourth roof sections 42, 44, 46 and 48. The second set of tracks 56 can include first, second, third and fourth tracks 56*a*-56*d* that respectively support the second ends 52 of the first, second, third and fourth roof sections 42, 44, 46 and 48.

The depicted tracks 54, 56 have rounded profiles that match with rounded profiles of the rollers 60. In other examples, the tracks and rollers can have alternative profiles (e.g., tracks having angled roller engaging surfaces that meet at a point/peak and rollers having complementary profiles).

The first roof section 42 is moveable along the first and second sets of tracks 54, 56 with its first end 50 supported at the first track 54*a* of the first set of tracks 54 and its second end 52 supported at the first track 56*a* of the second set of tracks 56. The peak of the first roof section 42 is positioned directly above the ridge beam 40 and extend along the ridge beam 40. First and second rollers 60*a*, 60*b* are carried with the first roof section 42 and spaced-apart along the peak of the first roof section 42 for transferring load from the first roof section 42 downwardly to the ridge beam 40. The rollers 60*a*, 60*b* can ride on a track on the ridge beam 40 and can be vertically adjustable with respect to the first roof section 42.

The second roof section 44 is moveable along the first and second sets of tracks 54, 56 with its first end 50 supported at the second track 54*b* of the first set of tracks 54 and its second end 52 supported at the second track 56*b* of the second set of tracks 56. The peak of the second roof section is positioned directly above the ridge beam 40 and extends along the ridge beam 40. The second tracks 54*b*, 56*b* of the first and second sets of tracks 54, 56 are positioned outside the first tracks 54*a*, 56*a* of the first and second sets of tracks 54, 56.

Third and fourth rollers 60*c*, 60*d* are carried with the second roof section 44 and spaced-apart along the peak of the second roof section 44 for transferring load from the second roof section 44 downwardly to the ridge beam 40. The third roller 60*c* rides above the peak of the first roof section 42 (e.g., on a track on the peak of the first roof section 42) such that load from the second roof section 44 is transferred from the third roller 60*c* through the first roof section 42 to the ridge beam 40. The fourth roller 60*d* rides above the ridge beam 40 (e.g., on the track supported by the ridge beam 40) and is arranged such that load from the second roof section 44 is transferred to the ridge beam 40 without passing through the first roof section 42. The third and fourth rollers 60*c*, 60*d* can be vertically adjustable with respect to the second roof section 44.

The first roof section 42 is nestable within the second roof section 44. When the roof arrangement is in the retracted state at least a majority of the first roof section 42 is nested within the second roof section 44. When the roof arrangement is in the extended state at least a majority of the first roof section 42 extends beyond the second roof section 44.

The third roof section 46 is moveable along the first and second sets of tracks 54, 56 with its first end 50 supported at a third track 54*c* of the first set of tracks 54 and its second end 52 supported at a third track 56*c* of the second set of tracks 56. The peak of the third roof section 46 is positioned directly above the ridge beam 40 and extends along the ridge beam 40. The third tracks 54*c*, 56*c* of the first and second sets of tracks 54, 56 are positioned outside the second tracks 54*b*, 56*b* of the first and second sets of tracks 54, 56.

Fifth and sixth rollers 60*e*, 60*f* are carried with the third roof section 46 and are spaced-apart along the peak of the third roof section 46 for transferring load from the third roof section 46 downwardly to the ridge beam 40. The fifth roller 60*e* rides above the peak of the second roof section 44 (e.g., along a track supported on the peak of the second roof section 44) such that load from the third roof section 46 is transferred from the fifth roller 60*e* through the second roof section 44 to the ridge beam 40. The sixth roller 60*f* rides above the ridge beam 40 and is arranged such that load from the third roof section 46 is transferred to the ridge beam 40 without passing through the second roof section 44.

The second roof section 44 is nestable within the third roof section 46. When the roof arrangement is in the retracted state at least a majority of the second roof section 44 is nested within the third roof section 46. When the roof arrangement is in the extended state at least a majority of the second roof section 44 extends beyond the third roof section 46.

The fourth roof section 48 is moveable along the first and second sets of tracks 54, 56 with its first end 50 supported at a fourth track 54*d* of the first set of tracks 54 and its second end 52 supported at a fourth track 56*d* of the second set of tracks 56. The peak of the fourth roof section 48 is positioned directly above the ridge beam 40 and extends along the ridge beam 40. The fourth tracks 54*d*, 56*d* of the first and second sets of tracks 54, 56 are positioned outside the third tracks 54*c*, 56*c* of the first and second sets of tracks 54, 56.

Seventh and eighth rollers 60*g*, 60*h* are carried with the fourth roof section and are spaced-apart along the peak of the fourth roof section 48 for transferring load from the fourth roof section 48 downwardly to the ridge beam 40. The seventh roller 60*g* riding above the peak of the third roof section 46 such that load from the fourth roof section 48 is transferred from the seventh roller 60*g* through the third roof section 46 to the ridge beam 40. The eighth roller 60*h* rides above the ridge beam 40 and is arranged such that load from the fourth roof section 48 is transferred to the ridge beam 40 without passing through the third roof section 46.

The third roof section 46 is nestable within the fourth roof section 48. When the roof arrangement is in a retracted state, at least a majority of the third roof section 46 is nested within the fourth roof section 48. When the roof arrangement is in an extended state, at least a majority of the third roof section 46 extends beyond the fourth roof section 48.

The fifth roof section 51 is fixed relative to the first and second headers 30, 31 to inhibit movement of the fifth roof section 51 along the headers. The fifth roof section 51 includes a first end 50 supported at the first header 30, a second end 52 supported at the second header 31, and a peak positioned above the ridge beam 40.

A ninth roller 60*i* is connected to the fifth roof section 51 and spaced-apart along the peak from a truss supported end 100 of the fifth roof section 51. The ninth roller 60*i* rides above the peak of the fourth roof section 48 such that load from the fifth roof section 51 is transferred from the ninth roller 60*i* through the fourth roof section 48 to the ridge beam 40. The fourth roof section 48 is nestable within the fifth roof section 51. When the roof arrangement is in a retracted state, at least a majority of the fourth roof section 48 is nested within the fifth roof section 51. When the roof arrangement is in an extended state, at least a majority of the fourth roof section 48 extends beyond the fifth roof section 51.

FIGS. 7-12 depict another building structure 220 in accordance with the principles of the present disclosure. The building structure 220 has a double roof construction in which two separate retractable first and second roof arrangements 222, 224 can be used to cover a room 226 having a convertible area 227. The roof arrangements 222, 224 can independently cover the convertible area 227, or can both cover the convertible area 227. In one example, the roof arrangements 222, 224 can each have the same type of retractable design (e.g., including nestable roof sections, rollers, tracks and ridge beam support) as the roof arrangement 36. In some examples (e.g., particularly examples having shorter span lengths), the ridge beam support may be eliminated. In the depicted example, the first roof arrangement 222 is a lower roof arrangement and the second roof arrangement 224 is an upper roof arrangement that extends over the lower roof arrangement in both the extended and retracted states.

Figure 7:
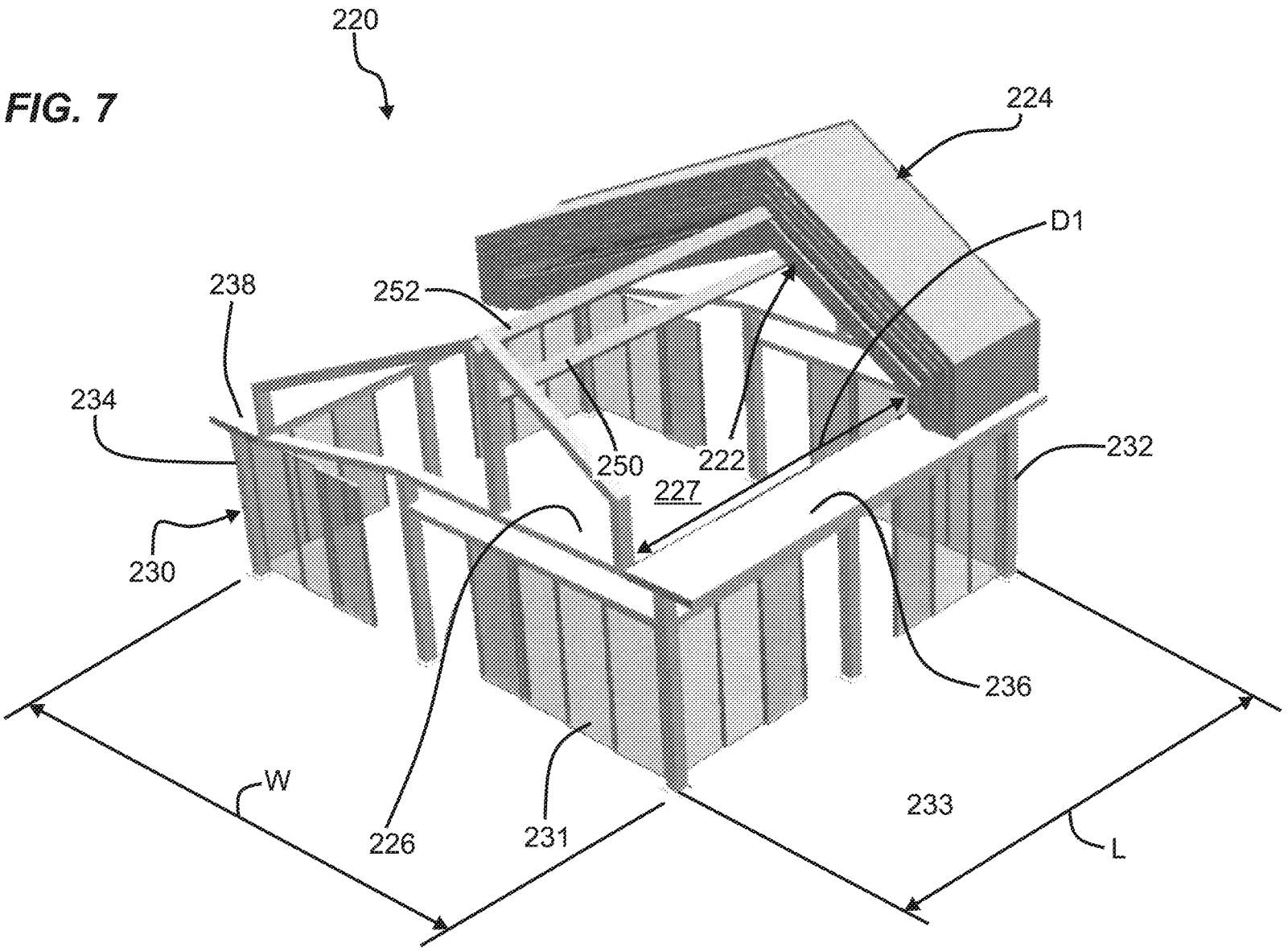
FIG. 7 is a first view depicting a building with a double roof arrangement in accordance with the principles of the present disclosure shown in a first configuration in which both roof arrangement are retracted.
Figure 8:
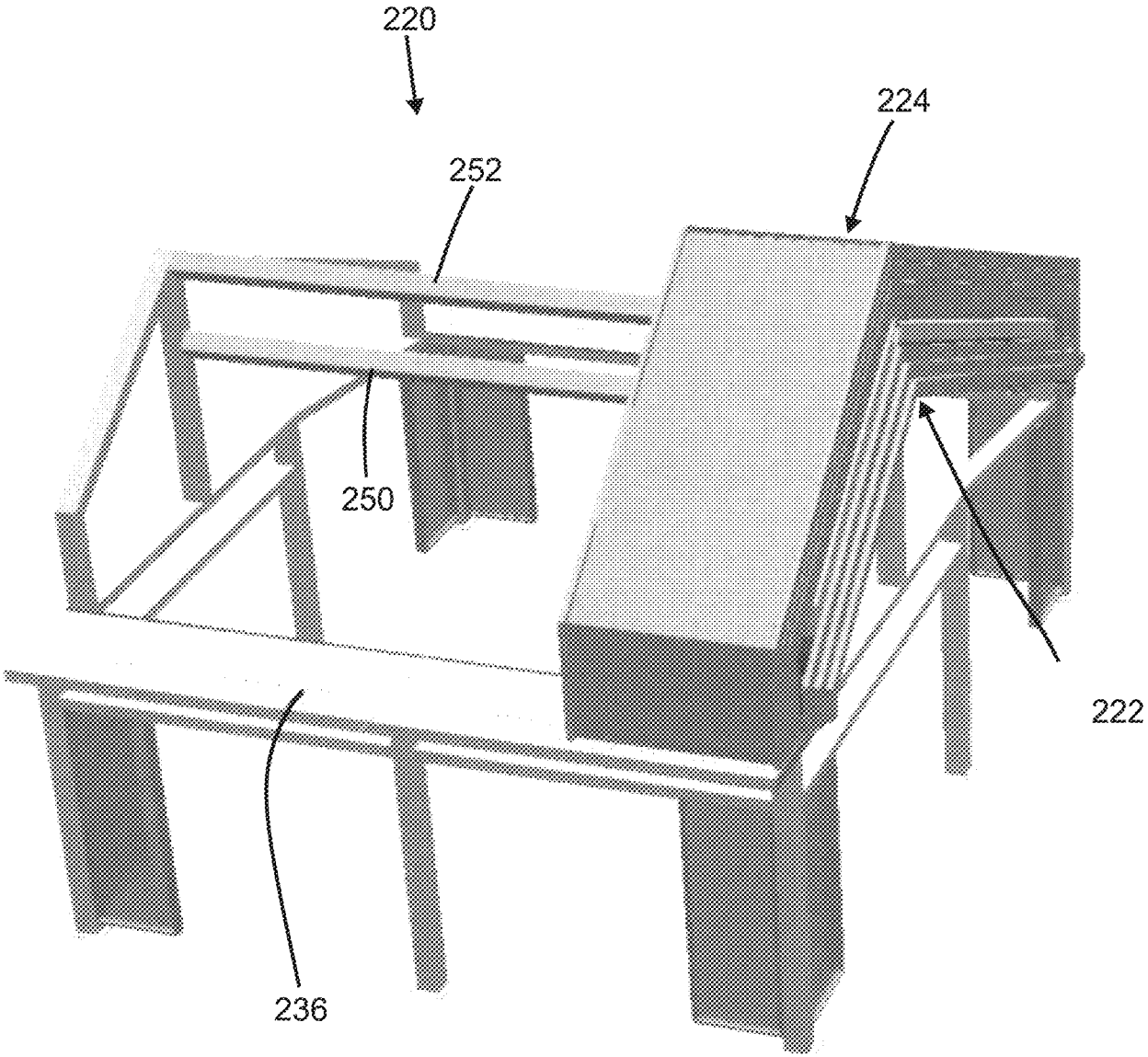
FIG. 8 is a second view depicting the building of FIG. 7 in the first configuration.
Figure 9:
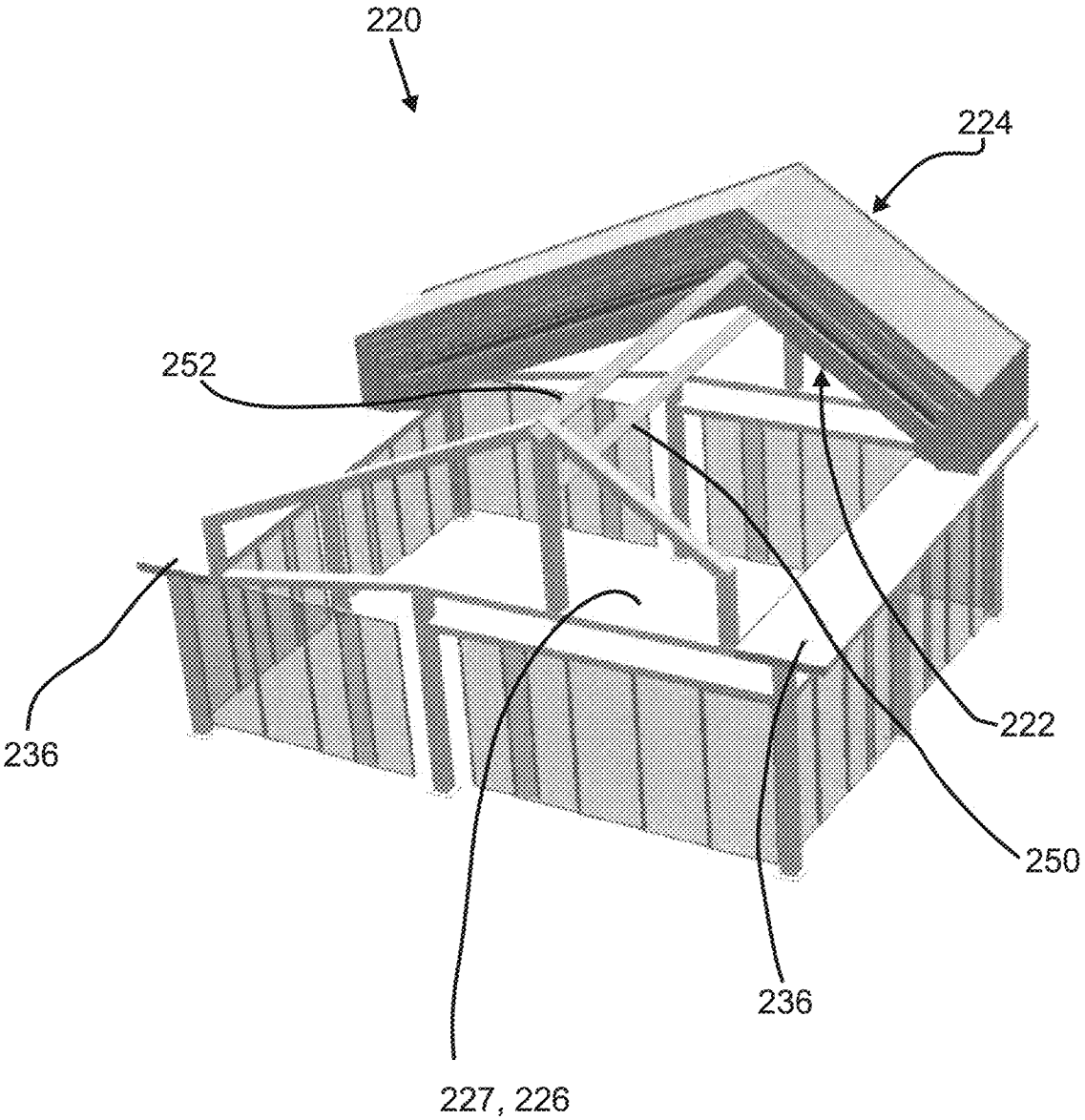
FIG. 9 is a third view depicting the building of FIG. 7 in the first configuration.
Figure 10:
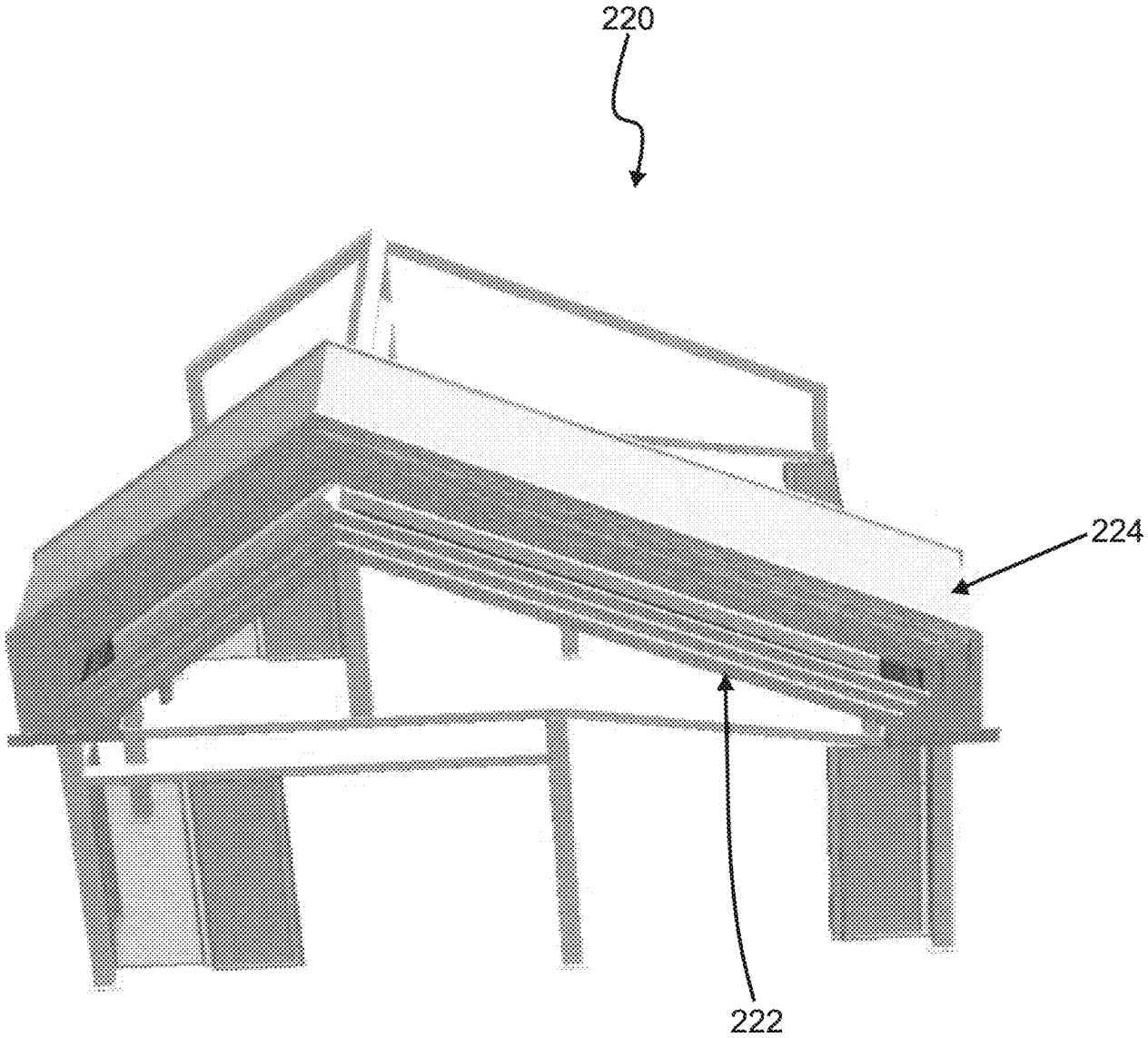
FIG. 10 is a fourth view depicting the building of FIG. 7 in the first configuration.
Figure 11:
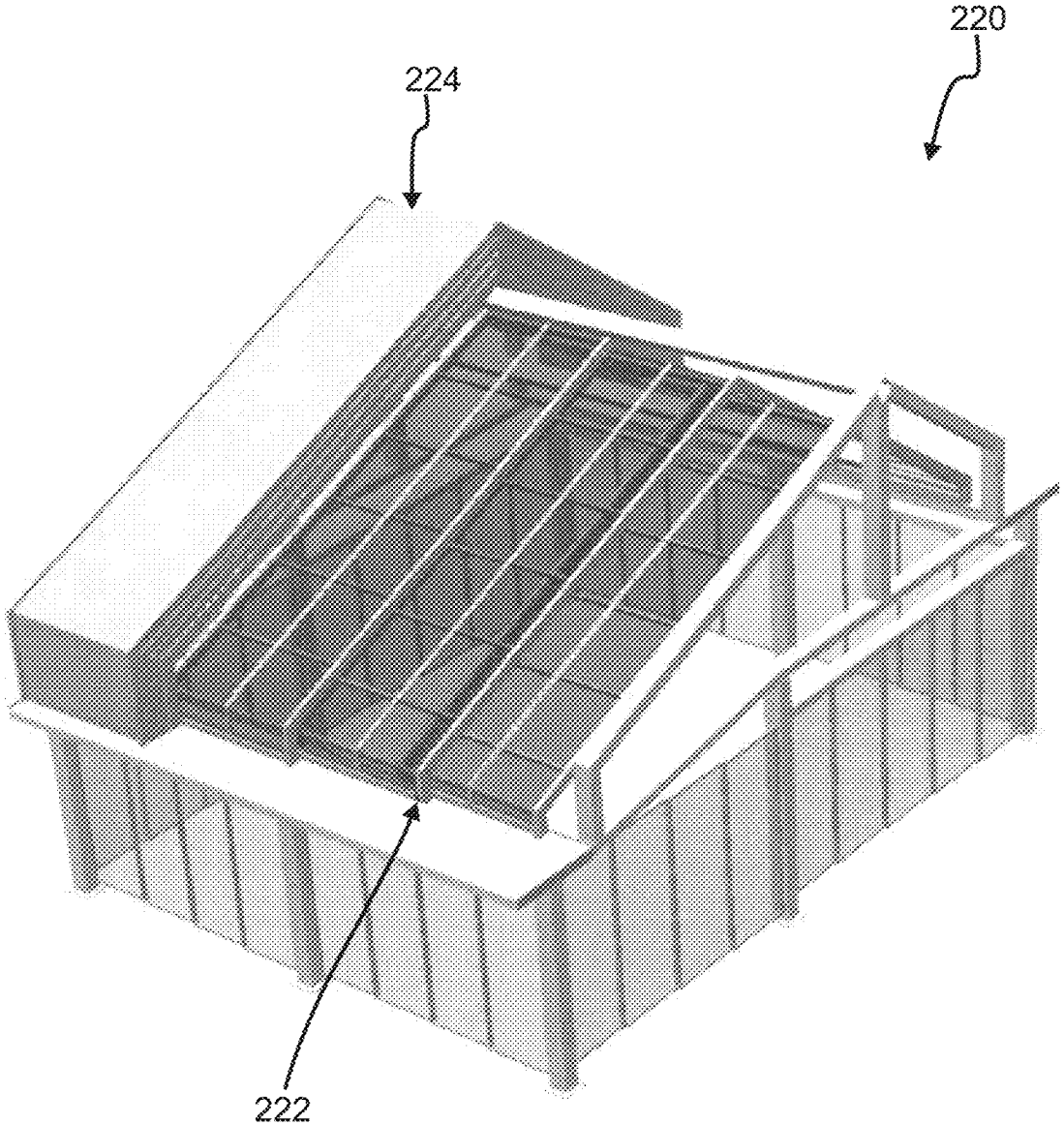
FIG. 11 shows the building of FIGS. 7-10 with the double roof arrangement in a second configuration in which one roof arrangement is extended and the other roof arrangement is retracted.
Figure 12:
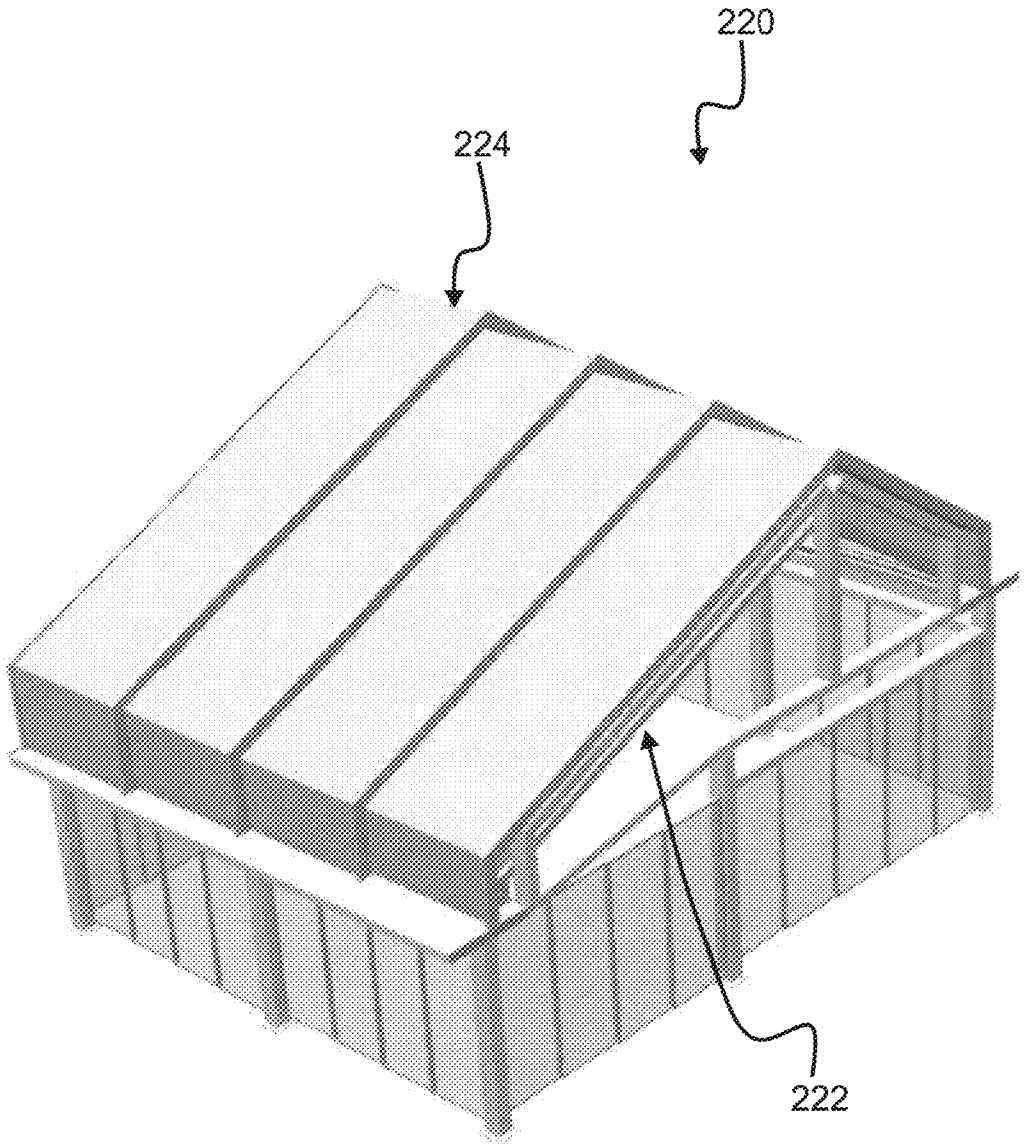
FIG. 12 shows the building of FIGS. 7-10 in a third configuration in which both roof arrangements are extended.

The first roof arrangement 222 is movable between an extended state (see FIG. 11) and a retracted state (see FIG. 7). When the first roof arrangement 222 is in the extended state, the first roof section 222 extends over the convertible area 227. When the first roof arrangement 222 is in the retracted state, the first roof section 222 does not extend over the convertible area 227.

The second roof arrangement 224 movable between an extended state (see FIG. 12) and a retracted state (see FIG. 7). When the second roof arrangement 224 is in the extended state, the second roof section 224 extends over the convertible area 227. When the second roof arrangement 224 is in the retracted state, the second roof section does not extend over the convertible area 227.

In one example, the first roof arrangement 222 and the second roof arrangement 224 have different thermal resistance values or have different light transmission properties. For example, the second roof arrangement 224 can provide more thermal resistance (e.g., have a higher R-value; provide better thermal insulating properties) than the first roof arrangement 222. In another example, the first roof arrangement 222 can be more transmissive to light than the second roof arrangement 224 (e.g., the first roof arrangement can be transparent and the second roof arrangement can be opaque). In one example, the room is functional as conditioned space (capable of being efficiently heated or cooled) when the first and second roof arrangements are both in the extended state.

In one example the building structure can be arranged in different configurations providing different characteristics to the convertible space. For example, a region above the convertible area 227 is open to outside air when the first and second roof arrangements are in the retracted states thereby allowing the convertible space to be arranged in an open-air configuration. The region above the convertible area is covered and transmissive to outside light when the first roof arrangement is in the extended state and the second roof arrangement is in the retracted state thereby allowing the convertible space to be arranged in natural lighting configuration. The region above the convertible state is not light transmissive and preferably better thermally insulated when the first and second roof arrangements are in the extended states thereby allowing the convertible space to be arranged in a room darkening configuration or a conditioned state.

Referring to FIGS. 7-12, the building structure 220 includes a frame 230 having opposite first and second end walls 231, 232 defining a width W of the building structure 220 and opposite first and second side walls 233, 234 defining a length L of the building 20. The end walls 231, 232 and the side walls 233, 234 can be supported on a foundation or other structure. The first and second side walls 231, 232 preferably include respective first and second headers 236, 238 positioned at the tops of the sidewalls 233, 234 preferably above head level (e.g., preferably above at least 6 feet, 7 feet or 8 feet). The headers 236, 238 are depicted extending along the length L of the building structure 220. The frame 230 can also include trusses that extend across the width W of the building structure 220. In one example, a distance D1 along the length corresponds to a region of the building structure 220 that can be opened and closed. The first and second roof arrangements 222, 224 each extend fully over the convertible area across the distance D1 when in the extended state with the first roof arrangement 222 located directly beneath the second roof arrangement. In the retracted states, the first and second roof arrangements 222, 224 do not cover the convertible space 227 and the first roof arrangement 222 is directly beneath the second roof arrangement 224.

The first and second roof arrangements 222, 224 each include peaked roof sections that are nestable at least when in the retracted state. First ends of the peaked roof sections are supported at the first header 236 (e.g., by tracks and rollers) and second ends of the peaked roof sections are supported at the second header 238 (e.g., by tracks and rollers). The building structure 220 includes a first ridge beam 250 and a second ridge beam 252 positioned directly above the first ridge beam 250. The first and second ridge beams 250, 252 are parallel to the first and second headers 236, 238. The peaks of the roof sections of the first roof arrangement 222 are supported by the first ridge beam 250, and the peaks of the roof sections of the second roof arrangement 224 are supported by the second ridge beam 252.

In one example, the convertible area 227 has an area less than or equal to 5000 square feet, or 4000 square feet, or 3000 square feet or 2000 square feet. In one example, the first roof arrangement 222 is light transmissive, and the second roof arrangement 224 is room darkening. In one example the first roof arrangement 222 is transparent and the second roof arrangement 224 is opaque. In one example, the first roof arrangement 222 has an R-value less than or equal to 6, or 5, or 4, or 3, or 2, or 1, and the second roof arrangement 224 has an R-value greater than or equal to 7, or 10, or 15, or 20, or 30, or 40, or 50, or 60. In one example, the first and second roof arrangements 222, 224 each move the same distance D1 between the extended and retracted states.

Vertical adjustment of the rollers relative to their corresponding roof sections can be accomplished by adjustable mechanical components coupled to the rollers such as telescopic members that can be vertically slid relative to one another to provide vertical adjustment of the rollers. The components can be secured (e.g., clamped, fastened) relative to one another to retain the rollers at desired vertical positions once adjusted. In another example, vertical adjustment members can include a threaded interface having adjustment members that are threaded together. By threading one of the adjustment members with respect to the other the vertical position of a roller can be adjusted. In will be appreciated that in certain examples, one or more of the rollers may not be vertically adjustable.

It will be appreciated that the rollers can be incorporated as part of force transfer components used to transfer vertical load between roof sections, to the headers and to the ridge beam. In other examples, rather than rollers, the force transfer components may include sliders constructed of a relatively low friction material suitable for sliding along the tracks.

It will be appreciated that roof arrangements in accordance with the principles of the present disclosure can be used for stand-alone buildings or can be built-out from other building structures (e.g., added on to existing building structures or integrated with another building structure as part of new construction).

In the depicted examples, the peaks of the roof sections are located at an intermediate position across the span lengths of the roof sections (e.g., between the headers). In some depicted examples (e.g., FIGS. 1-4), the intermediate locations of the peaks of the roof sections are located at a midpoint of a span length across which the roof sections extend such the two angled portions of each roof section are the same size and extend across half the span. In other examples (FIGS. 7-12), the intermediate locations of the peaks of the roof sections may be offset from the midpoint of the span length such that one angled portion of each roof section extends across a larger portion of the span length that the second angled portion of each roof section.

Certain aspects of the present disclosure are also applicable to single slope roofs (i.e., non-peaked roofs).

In one example, the roof sections of the first roof arrangement 222 do not contact (e.g., are not capable of contacting) the roof sections of the second roof arrangement 224. In one example, a vertical air gap exists between the first roof arrangement 222 and the second roof arrangement 224 at least when both the first and second roof arrangements 222, 224 are in the extended state.

In certain examples, the first and second roof arrangements 222, 224 may be stowed at opposite ends/sides of the convertible space when in the retracted states rather than being stowed one above the other. In such examples, the roof arrangements 222, 224 can move in opposite directions when moving from the retracted state to the extended state.

In one example, the convertible space has a distance that can be opened and closed by the first and second roof arrangements, wherein the distance extends along an orientation of movement of the first and second roof arrangements as the first and second roof arrangements move between the retracted and extended states, and wherein the first and second roof arrangements extend fully along the distance when in the extended states.

In one example, the second roof arrangement has an R-value at least 2, 3, 4, 5, 10 or 15 times as large as an R-value of the first roof arrangement.

From the forgoing detailed description, it will be evident that modifications and variations can be made without departing from the spirit and scope of the disclosure.

The invention claimed is:

1. A building structure defining a room having a convertible area, the building structure comprising:

a first roof arrangement movable between an extended state and a retracted state, wherein when the first roof arrangement is in the extended state the first roof section extends over the convertible area, and wherein when the first roof arrangement is in the retracted state the first roof section does not extend over the convertible area;

a second roof arrangement movable between an extended state and a retracted state, wherein when the second roof arrangement is in the extended state the second roof section extends over the convertible area, and wherein when the second roof arrangement is in the retracted state the second roof section does not extend over the convertible area;

wherein one of the first and second roof arrangements is positioned higher than the other of the first and second roof arrangements so as to be capable of extending over the other of the first and second roof arrangements at least when the first and second roof sections are in the extended state, and wherein the first and second roof arrangements are separate roof arrangements that are independently moveable between the extended and retracted states;

wherein the first roof arrangement and the second roof arrangement have different thermal resistance values or have different light transmission properties;

wherein the second roof arrangement is positioned above the first roof arrangement;

wherein the first and second roof arrangements each include peaked roof sections that are nestable, wherein the building structure includes a first header and a second header, wherein first ends of the peaked roof sections are supported at the first header and second ends of the peaked roof sections are supported at the second header; and wherein the building structure includes a first ridge beam and a second ridge beam positioned above the first ridge beam, wherein the first and second ridge beams are parallel to the first and second headers, wherein the peaks of the roof sections of the first roof arrangement are supported by the first ridge beam, and wherein the peaks of the roof sections of the second roof arrangement are supported by the second ridge beam.

2. The building structure of claim 1, wherein the first and second roof arrangements each extend fully over the convertible area when in the extended state.

3. The building structure of claim 1, wherein the convertible area has an area less than or equal to 5000 square feet.

4. The building structure of claim 1, wherein the first roof arrangement is light transmissive, and the second roof arrangement is room darkening.

5. The building structure of claim 1, wherein the first roof arrangement is transparent and the second roof arrangement is opaque.

6. The building structure of claim 1, wherein the first roof arrangement has an R-value less than or equal to 6, and the second roof arrangement has an R-value greater than or equal to 7.

7. The building structure of claim 1, wherein the room is functional as conditioned space when the first and second roof arrangements are both in the extended state.

8. The building structure of claim 1, wherein a region above the convertible area is open to outside air when the first and second roof arrangements are in the retracted states, wherein the region above the convertible area is covered and transmissive to outside light when the first roof arrangement is in the extended state and the second roof arrangement is in the retracted state, and wherein the region above the convertible state is not light transmissive when the first and second roof arrangements are in the extended states.

9. The building structure of claim 1, wherein the first and second roof arrangements each move the same distance between the extended and retracted states.

10. The building structure of claim 1, wherein the first roof arrangement is directly below the second roof arrangement when the first and second roof arrangements are both in the retracted state.

11. The building structure of claim 1, wherein the convertible area has an area less than or equal to 4000 square feet.

12. The building structure of claim 1, wherein the convertible area has an area less than or equal to 3000 square feet.

13. The building structure of claim 1, wherein the first roof arrangement has an R-value less than or equal to 6, and the second roof arrangement has an R-value greater than or equal to 10.

14. The building structure of claim 1, wherein the first roof arrangement has an R-value less than or equal to 6, and the second roof arrangement has an R-value greater than or equal to 15.

15. The building structure of claim 1, wherein the first roof arrangement has an R-value less than or equal to 6, and the second roof arrangement has an R-value greater than or equal to 30.

16. The building structure of claim 1, wherein the first roof arrangement has an R-value less than or equal to 4, and the second roof arrangement has an R-value greater than or equal to 7.

17. The building structure of claim 1, wherein the first roof arrangement has an R-value less than or equal to 4, and the second roof arrangement has an R-value greater than or equal to 10.

18. The building structure of claim 1, wherein the second roof arrangement has an R-value greater than or equal to 7.

19. The building structure of claim 1, wherein the second roof arrangement has an R-value greater than or equal to 10.

* * * * *